US011011843B2

(12) United States Patent
Onaka et al.

(10) Patent No.: US 11,011,843 B2
(45) Date of Patent: May 18, 2021

(54) ANTENNA ELEMENT, ANTENNA MODULE, AND COMMUNICATION APPARATUS

(71) Applicant: Murata Manufacturing Co., Ltd., Kyoto (JP)

(72) Inventors: Kengo Onaka, Kyoto (JP); Yoshiki Yamada, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 268 days.

(21) Appl. No.: 16/363,309

(22) Filed: Mar. 25, 2019

(65) Prior Publication Data

US 2019/0221937 A1 Jul. 18, 2019

Related U.S. Application Data

(63) Continuation of application No. PCT/JP2017/037251, filed on Oct. 13, 2017.

(30) Foreign Application Priority Data

Oct. 19, 2016 (JP) ..... JP2016-205578

(51) Int. Cl.
*H01Q 9/04* (2006.01)
*H01Q 19/00* (2006.01)
(Continued)

(52) U.S. Cl.
CPC ..... *H01Q 9/0414* (2013.01); *H01Q 3/26* (2013.01); *H01Q 5/385* (2015.01); *H01Q 5/392* (2015.01);
(Continued)

(58) Field of Classification Search
CPC ..... H01Q 9/0414; H01Q 3/26; H01Q 13/10; H01Q 21/065; H01Q 21/28; H01Q 5/392; H01Q 5/385; H01Q 19/005
See application file for complete search history.

(56) References Cited

U.S. PATENT DOCUMENTS 6,184,828 B1 2/2001 Shoki
9,209,519 B2 * 12/2015 Shinoda ..... H01Q 9/0435
(Continued)

FOREIGN PATENT DOCUMENTS

JP H06-326510 A 11/1994
JP H09-307338 A 11/1997
(Continued)

OTHER PUBLICATIONS

International Search Report for International Application No. PCT/JP2017/037251 dated Dec. 19, 2017.
(Continued)

*Primary Examiner* — Dimary S Lopez Cruz
*Assistant Examiner* — Michael M Bouizza
(74) *Attorney, Agent, or Firm* — Pearne & Gordon LLP

(57) ABSTRACT

A patch antenna includes a power feeding conductor pattern formed in a dielectric layer, a ground conductor pattern formed on the dielectric layer, a first parasitic conductor pattern and a second parasitic conductor pattern formed in/on the dielectric layer and is not set to have a ground potential. The first parasitic conductor pattern, the power feeding conductor pattern, the second parasitic conductor pattern, and the ground conductor pattern are arranged in this order in a cross section and overlap each other in a plan view. A resonant frequency f1 defined by an opposite-phase mode current flowing through the first parasitic conductor pattern is higher than a resonant frequency f2 defined by an in-phase mode current flowing through the power feeding conductor pattern, and a resonant frequency f3 defined by an opposite-phase mode current flowing through the second parasitic conductor pattern is lower than the resonant frequency f2.

18 Claims, 8 Drawing Sheets

(51) Int. Cl.

| | |
|---|---|
| ***H01Q 5/385*** | (2015.01) |
| ***H01Q 5/392*** | (2015.01) |
| ***H01Q 3/26*** | (2006.01) |
| ***H01Q 13/10*** | (2006.01) |
| ***H01Q 21/06*** | (2006.01) |
| ***H01Q 21/28*** | (2006.01) |

(52) U.S. Cl.

CPC ..... *H01Q 13/10* (2013.01); *H01Q 19/005* (2013.01); *H01Q 21/065* (2013.01); *H01Q 21/28* (2013.01)

(56) References Cited

U.S. PATENT DOCUMENTS

| | | | | |
|---|---|---|---|---|
| 9,379,453 | B2 * | 6/2016 | Rentz | H01Q 21/065 |
| 10,476,149 | B1 * | 11/2019 | Ueda | H01Q 5/385 |
| 2017/0222312 | A1 | 8/2017 | Sudo et al. | |
| 2018/0287268 | A1 | 10/2018 | Kosaka et al. | |

FOREIGN PATENT DOCUMENTS

| | | | |
|---|---|---|---|
| JP | 2806350 | B2 | 9/1998 |
| JP | 3006492 | B2 | 2/2000 |
| JP | 2010-62941 | A | 3/2010 |
| JP | 2011-155479 | A | 8/2011 |
| JP | 2011-166540 | A | 8/2011 |
| JP | 2016-025592 | A | 2/2016 |
| WO | 2016/059961 | A1 | 4/2016 |
| WO | 2016/132712 | A1 | 8/2016 |

OTHER PUBLICATIONS

Written Opinion for International Application No. PCT/JP2017/037251 dated Dec. 19, 2017.

* cited by examiner

ANTENNA ELEMENT, ANTENNA MODULE, AND COMMUNICATION APPARATUS

This is a continuation of International Application No. PCT/JP2017/037251 filed on Oct. 13, 2017 which claims priority from Japanese Patent Application No. 2016-205578 filed on Oct. 19, 2016. The contents of these applications are incorporated herein by reference in their entireties.

BACKGROUND

Technical Field

The present disclosure relates to an antenna element, an antenna module, and a communication apparatus.

As an antenna for wireless communication, for example, a microstrip-type array antenna disclosed in Patent Document 1, for example, can be cited. In the array antenna disclosed in Patent Document 1, a conductor ground plate, a dielectric plate, a plurality of power feeding patches arranged in a two-dimensional manner, a dielectric plate, and a plurality of parasitic patches arranged in a two-dimensional manner are arranged in this order. Each of the plurality of parasitic patches is arranged so as to be offset from the center of the opposing power feeding patch. Thus, phase adjustment of the array antenna can be easily performed.

Patent Document 1: Japanese Unexamined Patent Application Publication No. 9-307338

SUMMARY OF DISCLOSURE

Technical Problem

However, although the array antenna described in Patent Document 1 enables easy directivity control of antenna radiation, it does not have a function of eliminating spurious radiation of transmission waves and reception of unwanted waves contained in reception waves. Therefore, there is a concern over deterioration in quality of a transmission signal and reception sensitivity. In order to ensure quality of the transmission and reception signals, it is necessary for a front end circuit to which the array antenna is connected to have a filter function for suppressing the spurious radiation and the reception of the unwanted wave, and in this case, it is difficult to reduce the size of the front end circuit including the array antenna.

Accordingly, the present disclosure provides an antenna element, an antenna module, and a communication apparatus, which are capable of suppressing unwanted wave radiation and deterioration in reception sensitivity.

An antenna element according to an aspect of the disclosure includes a dielectric layer, a planar power feeding conductor pattern that is formed in the dielectric layer and to which a radio frequency signal is fed, a planar first ground conductor pattern that is formed on the dielectric layer so as to face the power feeding conductor pattern and is set to have a ground potential, a planar first parasitic conductor pattern that is formed on the dielectric layer so as to face the power feeding conductor pattern, to which no radio frequency signal is fed, and that is not set to have the ground potential, and a planar second parasitic conductor pattern that is formed in the dielectric layer so as to face the power feeding conductor pattern, to which no radio frequency signal is fed, and that is not set to have the ground potential, wherein the first parasitic conductor pattern, the power feeding conductor pattern, the second parasitic conductor pattern, and the first ground conductor pattern are arranged in this order when the dielectric layer is seen in a cross section and overlap each other when the dielectric layer is seen in a plan view, a resonant frequency defined by opposite-phase mode currents flowing through the power feeding conductor pattern and the first parasitic conductor pattern is higher than a resonant frequency defined by in-phase mode currents flowing through the power feeding conductor pattern and the first ground conductor pattern, and a resonant frequency defined by opposite-phase mode currents flowing through the power feeding conductor pattern and the second parasitic conductor pattern is lower than the resonant frequency defined by the in-phase mode currents.

With this configuration, it is possible to obtain characteristics having a peak of antenna gain (conversion efficiency) at the resonant frequency defined by the in-phase mode currents and to provide minimum points of the antenna gain (conversion efficiency) in the vicinity of the resonant frequencies (on the high frequency side and the low frequency side of the resonant frequency defined by the in-phase mode currents) defined by the opposite-phase mode currents. Therefore, it becomes possible to provide bandpass filter characteristics to the antenna gain, so that radiation of unwanted waves such as spurious waves can be suppressed by the antenna element itself. Further, it is possible to suppress reception of unwanted waves in the vicinity of a reception band, so that reception sensitivity of a front end circuit including the antenna element can be improved. Moreover, since it is not necessary to separately provide a filter circuit required in the front end circuit, miniaturization of the front end circuit can be achieved.

In addition, an electric length of the power feeding conductor pattern in a polarization direction may be equal to or larger than an electric length of the first parasitic conductor pattern in the polarization direction and equal to or smaller than an electric length of the second parasitic conductor pattern in the polarization direction.

The electric length of a conductor pattern in the polarization direction, which determines an antenna radiation frequency, is determined by a wave length of a radio frequency signal that is spatially propagated and a relative permittivity of a dielectric layer. When the conductor pattern has a rectangular shape, the electric length thereof corresponds to the double of the length of the conductor pattern in the polarization direction. Therefore, when the electric lengths of the power feeding conductor pattern, the first parasitic conductor pattern, and the second parasitic conductor pattern in the polarization direction have the above relationship, it is possible to provide the bandpass filter characteristics to the antenna gain, so that the radiation of unwanted waves such as spurious waves can be suppressed by the antenna element itself. Further, the reception sensitivity of the front end circuit can be improved and miniaturization of the front end circuit can be achieved.

An antenna element according to another aspect of the disclosure includes a dielectric layer, a planar power feeding conductor pattern that is formed in the dielectric layer and to which a radio frequency signal is fed, a planar first ground conductor pattern that is formed on the dielectric layer so as to face the power feeding conductor pattern and is set to have a ground potential, a planar first parasitic conductor pattern that is formed on the dielectric layer so as to face the power feeding conductor pattern, to which no radio frequency signal is fed, and that is not set to have the ground potential, and a high pass filter circuit that is formed on a power feeding line for transmitting the radio frequency signal to the power feeding conductor pattern, wherein the first parasitic conductor pattern, the power feeding conductor pattern, and the first ground conductor pattern are arranged in this order when the dielectric layer is seen in a cross section and overlap each other when the dielectric layer is seen in a plan view, a resonant frequency defined by opposite-phase mode currents flowing through the power feeding conductor pattern and the first parasitic conductor pattern is higher than a resonant frequency defined by in-phase mode currents flowing through the power feeding conductor pattern and the first ground conductor pattern, and a cutoff frequency of the high pass filter circuit is lower than the resonant frequency defined by the in-phase mode currents.

With this configuration, it is possible to obtain characteristics having a peak of antenna gain (conversion efficiency) at the resonant frequency defined by the in-phase mode currents and to provide a minimum point of the antenna gain (conversion efficiency) in the vicinity of the resonant frequency (on the high frequency side of the resonant frequency defined by the in-phase mode currents) defined by the opposite-phase mode currents. Further, it is possible to provide a minimum point of the antenna gain (conversion efficiency) in the vicinity of the cutoff frequency (on the lower frequency side of the resonant frequency defined by the in-phase mode currents). Therefore, it becomes possible to provide bandpass filter characteristics to the antenna gain (conversion efficiency), so that radiation of unwanted waves such as spurious waves can be suppressed by the antenna element itself. Further, it is possible to suppress reception of unwanted waves in the vicinity of a reception band, so that reception sensitivity of a front end circuit including the antenna element can be improved. Moreover, since it is not necessary to separately provide a filter circuit required in the front end circuit, miniaturization of the front end circuit can be achieved.

In addition, an electric length of the power feeding conductor pattern in a polarization direction may be equal to or larger than an electric length of the first parasitic conductor pattern in the polarization direction.

Since the electric lengths of the power feeding conductor pattern and the first parasitic conductor pattern in the polarization direction have the above relationship and the high pass filter circuit that generates a drop (attenuation pole) of the antenna gain on the low frequency side of the resonant frequency defined by the in-phase mode current is arranged, it is possible to provide the bandpass filter characteristics to the antenna gain. Thus, the radiation of unwanted waves such as spurious waves can be suppressed by the antenna element itself. Further, the reception sensitivity of the front end circuit can be improved and miniaturization of the front end circuit can be achieved.

The antenna element may further include a notch antenna that is formed on a surface of the dielectric layer or inside the dielectric layer on an outer peripheral portion of the power feeding conductor pattern in the plan view, and the notch antenna may include a planar second ground conductor pattern formed on the surface, a ground non-formation region interposed between portions of the second ground conductor pattern, a radiation electrode formed on the surface in the ground non-formation region, and a capacitive element arranged in the ground non-formation region and connected to the radiation electrode.

With this configuration, since the antenna element includes the patch antenna and the notch antenna, they can support different frequency bands, so that a multi-band antenna can be easily designed. Further, since the patch antenna and the notch antenna have different directivity, it is possible to simultaneously have directivity in a plurality of directions.

The antenna element may include the plurality of antenna elements arrayed in a one-dimensional or two-dimensional manner, and the plurality of antenna elements may share the dielectric layer and share the first ground conductor pattern.

With this configuration, it is possible to form the antenna element in which the plurality of patch antennas is arranged in a one-dimensional or two-dimensional manner on the same dielectric layer. Thus, it is possible to realize a phased array antenna which has a filter function in the antenna gain characteristics and can control directivity with an adjusted phase for each patch antenna.

An antenna module according to still another aspect of the disclosure includes the above-described antenna element, and a power feeding circuit that feeds the radio frequency signal to the power feeding conductor pattern, wherein the first parasitic conductor pattern is formed on a first main surface of the dielectric layer, the first ground conductor pattern is formed on a second main surface of the dielectric layer, which opposes the first main surface, and the power feeding circuit is formed on the second main surface side of the dielectric layer.

With this configuration, radiation of unwanted waves such as spurious waves can be suppressed by the antenna element itself. Further, it is possible to suppress reception of unwanted waves in the vicinity of a reception band, so that reception sensitivity of the antenna module can be improved. Moreover, since it is not necessary to separately provide a filter circuit required in a power feeding circuit, miniaturization of the antenna module can be achieved.

A communication apparatus according to still another aspect of the disclosure includes the above-described antenna element, and an RF signal processing circuit that feeds the radio frequency signal to the power feeding conductor pattern, wherein the RF signal processing circuit includes a phase shift circuit shifting a phase of the radio frequency signal, an amplifying circuit amplifying the radio frequency signal; and a switch element switching connection between a signal path through which the high-frequency signal propagates and the antenna element.

With this configuration, it is possible to realize a multi-band/multi-mode communication apparatus capable of controlling directivity of antenna gain while suppressing radiation of unwanted waves such as spurious waves and improving reception sensitivity.

A communication apparatus according to still another aspect of the disclosure includes a first array antenna and a second array antenna, an RF signal processing circuit that feeds a radio frequency signal to a power feeding conductor pattern, and a housing in which the first array antenna, the second array antenna, and the RF signal processing circuit are arranged, wherein the housing is a hexahedron having a first outer peripheral surface as a main surface, a second outer peripheral surface opposing the first outer peripheral surface, a third outer peripheral surface perpendicular to the first outer peripheral surface, a fourth outer peripheral surface opposing the third outer peripheral surface, a fifth outer peripheral surface perpendicular to the first outer peripheral surface and the third outer peripheral surface, and a sixth outer peripheral surface opposing the fifth outer peripheral surface, the first array antenna includes a first antenna element as the above-described antenna element, which is arranged such that a direction from the first ground conductor pattern toward the power feeding conductor pattern coincides with a first direction from the second outer peripheral surface toward the first outer peripheral surface and a direction from the power feeding conductor pattern toward the notch antenna coincides with a second direction from the fourth outer peripheral surface toward the third outer peripheral surface, and a second antenna element as the above-described antenna element, which is arranged such that the direction from the first ground conductor pattern toward the power feeding conductor pattern coincides with the first direction and the direction from the power feeding conductor pattern toward the notch antenna coincides with a third direction from the sixth outer peripheral surface toward the fifth outer peripheral surface, and the second array antenna includes a third antenna element as the above-described antenna element, which is arranged such that the direction from the first ground conductor pattern toward the power feeding conductor pattern coincides with a fourth direction from the first outer peripheral surface toward the second outer peripheral surface and the direction from the power feeding conductor pattern toward the notch antenna coincides with a fifth direction from the third outer peripheral surface toward the fourth outer peripheral surface, and a fourth antenna element as the above-described antenna element, which is arranged such that the direction from the first ground conductor pattern toward the power feeding conductor pattern coincides with the fourth direction and the direction from the power feeding conductor pattern toward the notch antenna coincides with a sixth direction from the fifth outer peripheral surface toward the sixth outer peripheral surface.

With this configuration, the first array antenna has directivity in the first direction, the second direction, and the third direction of the communication apparatus. Further, the second array antenna has directivity in the fourth direction, the fifth direction, and the sixth direction of the communication apparatus. Thus, it is possible to provide directivity in all directions of the communication apparatus.

According to the present disclosure, since antenna gain having band pass filter characteristics can be realized, it is possible to suppress radiation of unwanted waves such as spurious waves by the antenna element itself.

DETAILED DESCRIPTION

Figure 1:
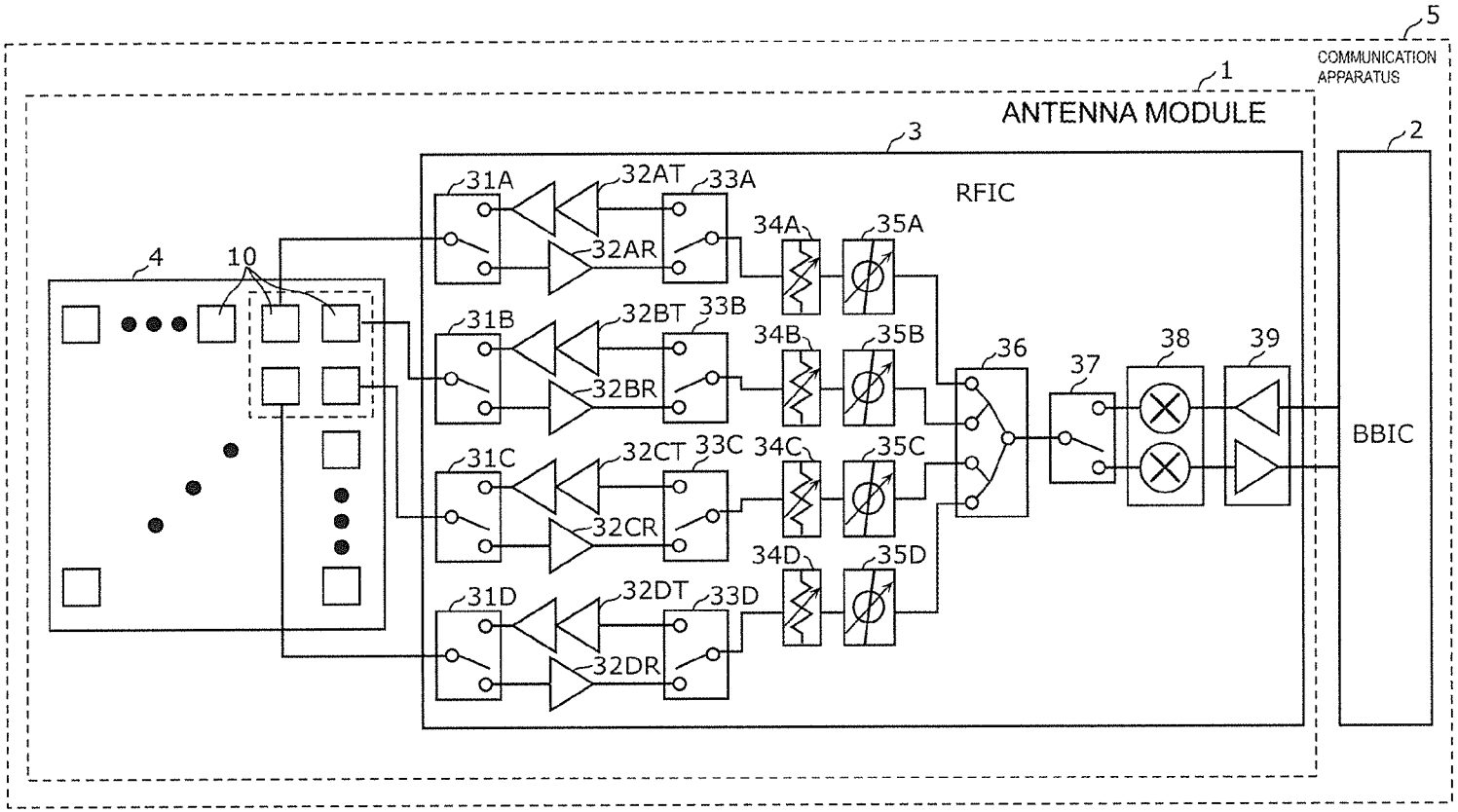
FIG. 1 is a circuit diagram illustrating a communication apparatus (antenna module) and a peripheral circuit according to a first embodiment.

Hereinafter, embodiments of the present disclosure will be described in detail with reference to the accompanying drawings. It should be noted that each of the embodiments described below represents a comprehensive or specific example. Numerical values, shapes, materials, components, arrangement and connection forms of the components, and the like described in the following embodiments are merely examples and are not intended to limit the disclosure. Components of the following embodiments that are not described in the independent claims will be described as optional components. Further, sizes or size ratios of the components illustrated in the drawings are not necessarily critical.

First Embodiment

[1.1 Circuit Configuration of Communication Apparatus (Antenna Module)]

FIG. 1 is a circuit diagram of a communication apparatus 5 according to a first embodiment. The communication apparatus 5 illustrated in FIG. 1 includes an antenna module 1 and a baseband signal processing circuit (BBIC) 2. The antenna module 1 includes an array antenna 4 and an RF signal processing circuit (RFIC) 3. The communication apparatus 5 up-converts a signal transmitted from the baseband signal processing circuit (BBIC) 2 to the antenna module 1 into a radio frequency signal and radiates the signal from the array antenna 4 whereas it down-converts a radio frequency signal received by the array antenna 4 and performs signal processing on the signal in the baseband signal processing circuit (BBIC) 2.

The array antenna 4 has a plurality of patch antennas 10 arrayed in a two-dimensional manner. The patch antenna 10 is an antenna element that operates as a radiating element radiating radio waves (radio frequency signals) and a reception element receiving radio waves (radio frequency signals) and have main characteristics of the disclosure. In this embodiment, the array antenna 4 can constitute a phased array antenna.

The patch antennas 10 have band pass filter characteristics in antenna gain. Thus, it is possible to suppress radiation of unwanted waves such as spurious waves by the patch antennas 10 themselves. Further, it is possible to suppress reception of unwanted waves in the vicinity of a reception band, so that reception sensitivity of the antenna module 1 including the patch antennas 10 can be improved. In addition, since it is not necessary to separately provide a filter circuit required in the antenna module 1, miniaturization of the antenna module 1 can be achieved. Details of the main characteristics of the patch antennas 10 will be described later.

The RF signal processing circuit (RFIC) 3 includes switches 31A to 31D, 33A to 33D, and 37, power amplifiers 32AT to 32DT, low noise amplifiers 32AR to 32DR, attenuators 34A to 34D, phase shifters 35A to 35D, a signal multiplexer/demultiplexer 36, a mixer 38, and an amplifier circuit 39.

The switches 31A to 31D and 33A to 33D are switching circuits for switching transmission and reception in signal paths.

The signal transmitted from the baseband signal processing circuit (BBIC) 2 is amplified by the amplifier circuit 39 and up-converted by the mixer 38. The up-converted radio frequency signal is demultiplexed into four signals by the signal multiplexer/demultiplexer 36, and the demultiplexed signals pass through four transmission paths to be fed to different patch antennas 10. At this time, it is possible to adjust the directivity of the array antenna 4 by individually adjusting phase shift degrees of the phase shifters 35A to 35D arranged in the respective signal paths.

Further, the radio frequency signals received by the respective patch antennas 10 of the array antenna 4 pass through four different reception paths and are multiplexed by the signal multiplexer/demultiplexer 36. The multiplexed signal is down-converted by the mixer 38, is amplified by the amplifier circuit 39, and is transmitted to the baseband signal processing circuit (BBIC) 2.

The RF signal processing circuit (RFIC) 3 is formed as a one-chip integrated circuit component including, for example, the circuit configuration described above.

Note that the RF signal processing circuit (RFIC) 3 may not include any of the switches 31A to 31D, 33A to 33D, and 37, the power amplifiers 32AT to 32DT, the low noise amplifiers 32AR to 32DR, the attenuators 34A to 34D, the phase shifters 35A to 35D, the signal multiplexer/demultiplexer 36, the mixer 38, and the amplifier circuit 39. Further, the RF signal processing circuit (RFIC) 3 may have only one of the transmission path and the reception path. The communication apparatus 5 according to the embodiment is applicable to a system that not only transmits and receives radio frequency signals of a single frequency band (band) but also transmits and receives radio frequency signals of a plurality of frequency bands (multi-band).

[1.2 Configuration of Patch Antenna]

Figure 2:
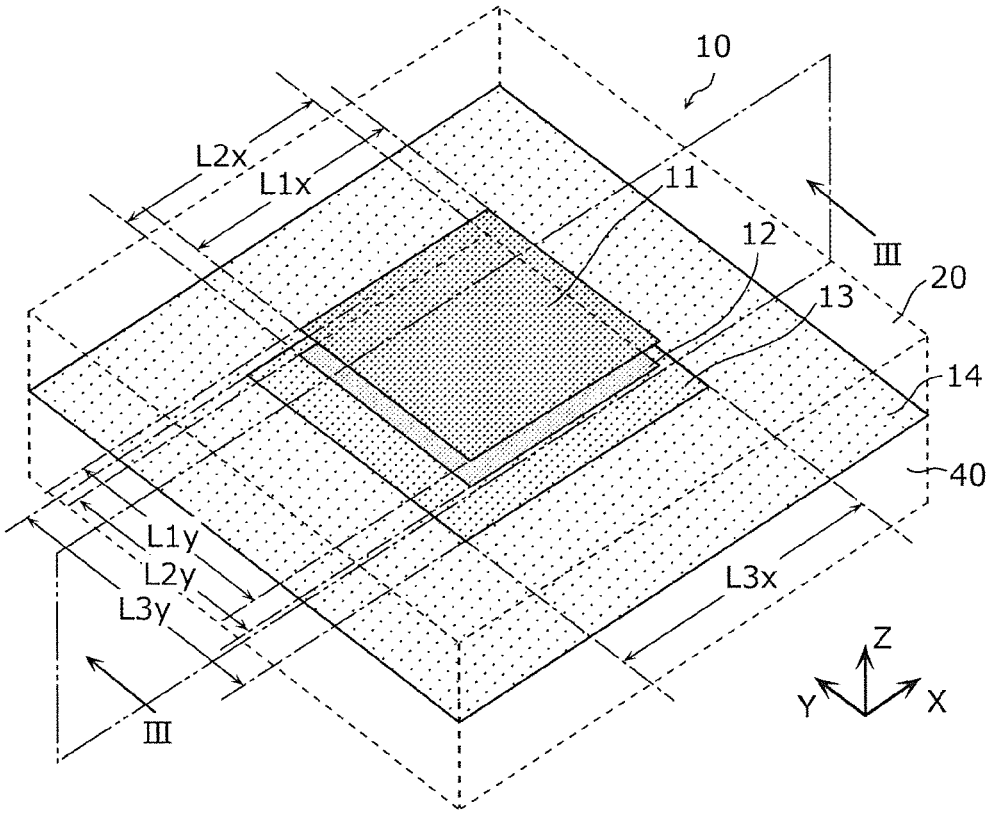
FIG. 2 is a perspective view illustrating an outer appearance of a patch antenna according to the first embodiment.
Figure 3:
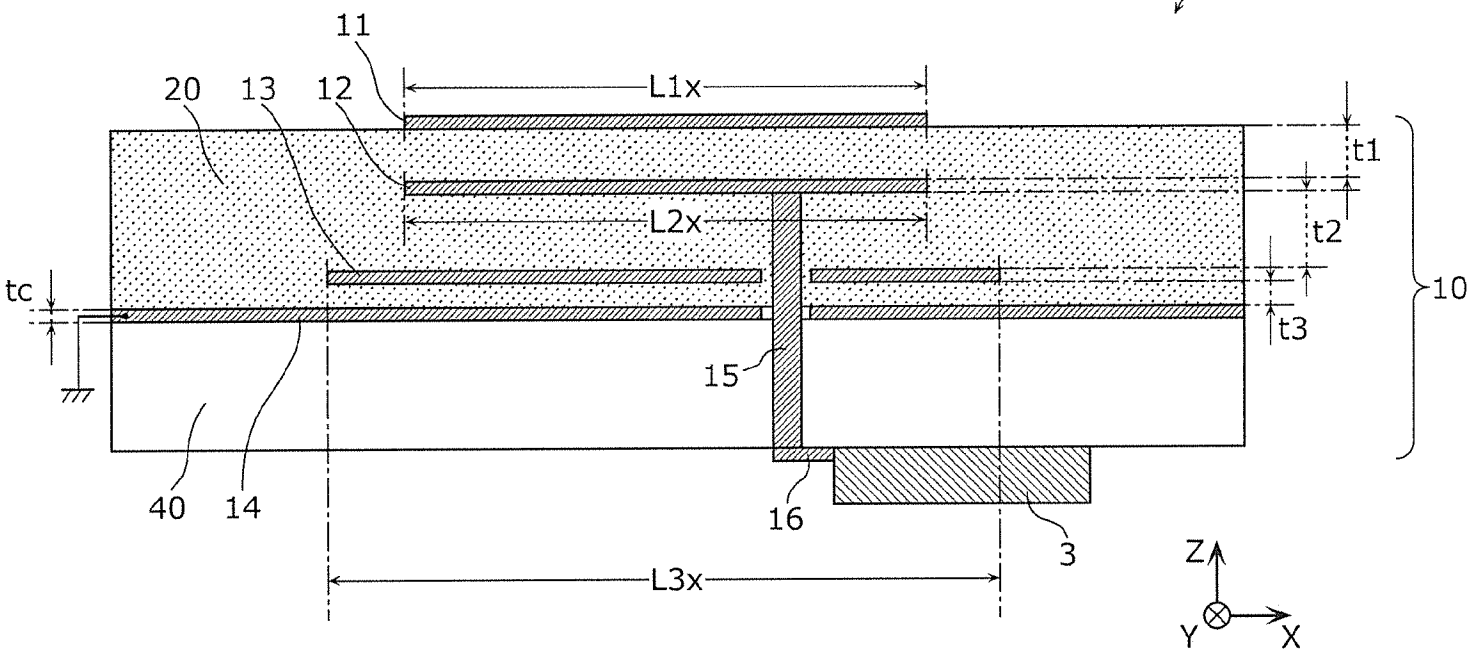
FIG. 3 is a cross-sectional view of the communication apparatus (antenna module) according to the first embodiment.

FIG. 2 is a perspective view illustrating an outer appearance of the patch antenna 10 according to the first embodiment. FIG. 3 is a cross-sectional view of the antenna module 1 according to the first embodiment. FIG. 3 is a cross-sectional view taken along a line III-III of FIG. 2. FIG. 2 illustrates conductor patterns constituting the patch antenna 10 while seeing through a dielectric layer 20.

As illustrated in FIG. 3, the antenna module 1 includes the patch antennas 10 and the RF signal processing circuit (RFIC) 3.

As illustrated in FIG. 2, the patch antenna 10 includes a first parasitic conductor pattern 11, a power feeding conductor pattern 12, a second parasitic conductor pattern 13, a ground conductor pattern 14, the dielectric layer 20, and a substrate 40.

As illustrated in FIG. 3, the power feeding conductor pattern 12 is a conductor pattern that is formed in the dielectric layer 20 so as to be substantially parallel to the main surface of the dielectric layer 20, and a radio frequency signal is fed thereto from the RF signal processing circuit (RFIC) 3 after passing through a conductor via 15. In the embodiment, the power feeding conductor pattern 12 has a rectangular shape.

As illustrated in FIG. 3, the ground conductor pattern 14 is a first ground conductor pattern that is formed in the dielectric layer 20 so as to be substantially parallel to the main surface of the dielectric layer 20 and is set to have a ground potential.

Each of the first parasitic conductor pattern 11 and the second parasitic conductor pattern 13 is a conductor pattern that is formed in/on the dielectric layer 20 so as to be substantially parallel to the main surface of the dielectric layer 20, to which no radio frequency signal is supplied, and that is not set to have a ground potential. In the embodiment, as illustrated in FIG. 2, each of the first parasitic conductor pattern 11 and the second parasitic conductor pattern 13 has a rectangular shape.

The first parasitic conductor pattern 11, the power feeding conductor pattern 12, the second parasitic conductor pattern 13, and the ground conductor pattern 14 are arranged in this order when the dielectric layer 20 is seen in a cross section (in a direction parallel to the main surface of the dielectric layer 20; see FIG. 3), and the adjacent conductor patterns overlap each other when the dielectric layer 20 is seen in a plan view (in a direction perpendicular to the main surface of the dielectric layer 20; see FIG. 2). Here, the fact that the adjacent conductor patterns overlap each other in the plan view includes not only a case where the whole region of one conductor pattern overlaps with the other conductor pattern but also a case where the center point (center of gravity) of one conductor pattern overlaps with the other conductor pattern.

The dielectric layer 20 has a multilayer structure that is filled with a dielectric material between the first parasitic conductor pattern 11 and the power feeding conductor pattern 12, between the power feeding conductor pattern 12 and the second parasitic conductor pattern 13, and between the second parasitic conductor pattern 13 and the ground conductor pattern 14. Note that the dielectric layer 20 may be, for example, a low temperature co-fired ceramics (LTCC) substrate, a printed substrate, or the like. The dielectric layer 20 may be simply a space that is not filled with the dielectric material. In this case, a structure for supporting the first parasitic conductor pattern 11 and the power feeding conductor pattern 12 is required.

As illustrated in FIG. 3, the ground conductor pattern 14 is arranged on a first main surface (surface) of the substrate 40, and the RF signal processing circuit (RFIC) 3 and a connection electrode 16 are arranged on a second main surface (back surface) of the substrate 40, which opposes the first main surface (surface). The conductor via 15 that connects the RF signal processing circuit (RFIC) 3 and the power feeding conductor pattern 12 is formed inside the substrate 40. Examples of the substrate 40 include a resin substrate, an LTCC substrate, a printed substrate, and the like.

Table 1 indicates dimensions and material parameters of the components forming the patch antenna 10 in the embodiment.

TABLE 1

| | |
|---|---|
| POWER FEEDING CONDUCTOR PATTERN 12 LENGTH L2x (mm), WIDTH L2y (mm) | 2.51 |
| FIRST PARASITIC CONDUCTOR PATTERN 11 LENGTH L1x (mm), WIDTH L1y (mm) | 2.51 |
| SECOND PARASITIC CONDUCTOR PATTERN 13 LENGTH L3x (mm), WIDTH L3y (mm) | 2.76 |
| GROUND CONDUCTOR PATTERN 14 LENGTH (mm), WIDTH (mm) | 10 |
| THICKNESS tc (μm) OF EACH CONDUCTOR PATTERN | 10 |
| INTERVAL t1 (mm) BETWEEN FIRST PARASITIC CONDUCTOR PATTERN 11 AND POWER FEEDING CONDUCTOR PATTERN 12 | 0.14 |

TABLE 1-continued

| | |
|---|---|
| INTERVAL t2 (mm) BETWEEN POWER FEEDING CONDUCTOR PATTERN 12 AND SECOND PARASITIC CONDUCTOR PATTERN 13 | 0.20 |
| INTERVAL t3 (mm) BETWEEN SECOND PARASITIC CONDUCTOR PATTERN 13 AND GROUND CONDUCTOR PATTERN 14 | 0.04 |
| RELATIVE PERMITTIVITY εr OF DIELECTRIC LAYER 20 | 3.5 |
| DIELECTRIC LOSS TANGENT tanδ OF DIELECTRIC LAYER 20 | 0.004 |

In the patch antenna 10, a power feeding point of the radio frequency signal, that is, a connection point between the conductor via 15 and the power feeding conductor pattern 12 deviates from a center point of the power feeding conductor pattern 12 in an X-axis direction. The patch antenna 10 is designed for matching at 50Ω, and in this case, the polarization direction of the patch antenna 10 is the X-axis direction.

Here, the length L2$x$ of the power feeding conductor pattern 12 that functions as a radiation plate of the patch antenna 10 is expressed by Equation 1, where λg is the electric length of the patch antenna 10.

$$L2x=\lambda g/2 \quad \text{(Equation 1)}$$

Further, the electric length λg is roughly expressed by the following Equation 2, where λ is the wavelength of a radio frequency signal that is spatially propagated.

$$\lambda g=\lambda/\varepsilon r^{1/2} \quad \text{(Equation 2)}$$

In the patch antenna having the above configuration, when the radio frequency signal is fed from the RF signal processing circuit (RFIC) 3 to the power feeding conductor pattern 12, in-phase radio frequency currents flow through the power feeding conductor pattern 12 and the ground conductor pattern 14. The radio frequency signal having a resonant frequency f2 defined by the in-phase mode radio frequency currents and the length L2$x$ of the power feeding conductor pattern 12 in the polarization direction (X-axis direction) is radiated from the power feeding conductor pattern 12 in directions about a Z-axis positive direction.

When the radio frequency signal is fed from the RF signal processing circuit (RFIC) 3 to the power feeding conductor pattern 12, a radio frequency current of a phase opposite to that of the power feeding conductor pattern 12 flows through the first parasitic conductor pattern 11. In the vicinity of a resonant frequency f1 defined by this opposite-phase mode radio frequency current and the length L1$x$ of the first parasitic conductor pattern 11 in the polarization direction (X-axis direction), radiation from the first parasitic conductor pattern 11 is suppressed.

When a radio frequency signal is fed from the RF signal processing circuit (RFIC) 3 to the power feeding conductor pattern 12, a radio frequency current of a phase opposite to that of the power feeding conductor pattern 12 flows through the second parasitic conductor pattern 13. In the vicinity of a resonant frequency f3 defined by this opposite-phase mode radio frequency current and the length L3$x$ of the second parasitic conductor pattern 13 in the polarization direction (the X-axis direction), radiation from the third parasitic conductor pattern 13 is suppressed.

In the patch antenna 10 according to the embodiment, the electric length (2×L2$x$) of the feeding conductor pattern 12 in the polarization direction (X-axis direction) is equal to or larger than the electric length (2×L1$x$) of the first parasitic conductor pattern 11 in the polarization direction (X-axis direction) and is equal to or smaller than the electric length (2×L3$x$) of the second parasitic conductor pattern 13 in the polarization direction (X-axis direction).

Thus, the resonant frequency f2 defined by the electric length (2×L2$x$) of the power feeding conductor pattern 12 in the polarization direction (X-axis direction) is lower than the resonant frequency f1 defined by the electric length (2×L1$x$) of the first parasitic conductor pattern 11 in the polarization direction (X-axis direction) and is higher than the resonant frequency f3 defined by the electric length (2×L3$x$) of the second parasitic conductor pattern 13 in the polarization direction (X-axis direction). Therefore, it is possible to provide band pass filter characteristics to antenna gain. This will be described in detail below using reflection characteristics of the patch antenna 10 and gain characteristics of antenna radiation.

[1.3 Reflection Characteristics and Radiation Characteristics of Patch Antenna]

Figure 4:
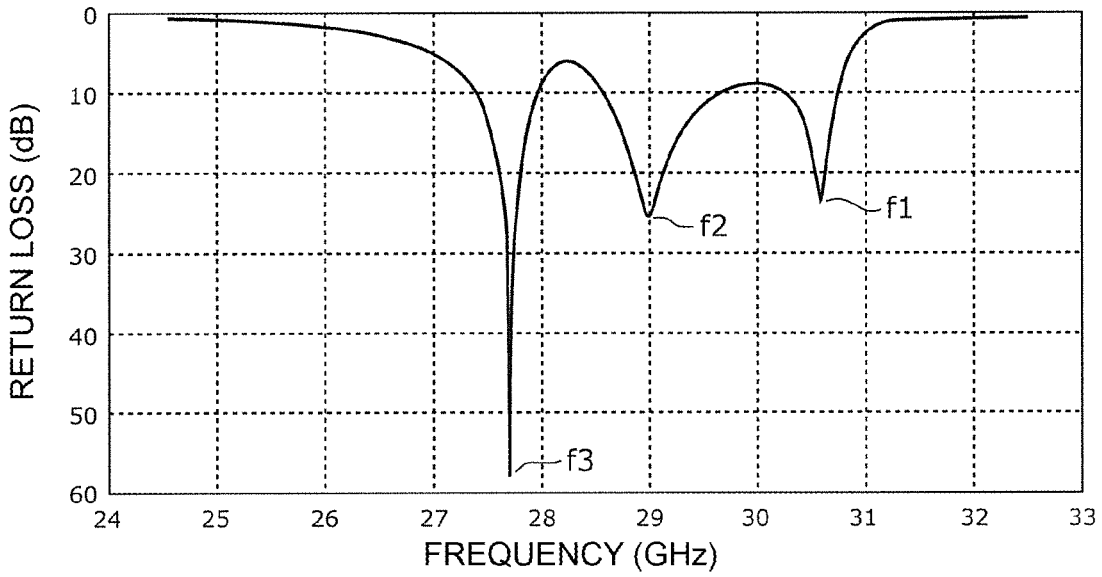
FIG. 4 is a graph illustrating reflection characteristics of the patch antenna according to the first embodiment.
Figure 5:
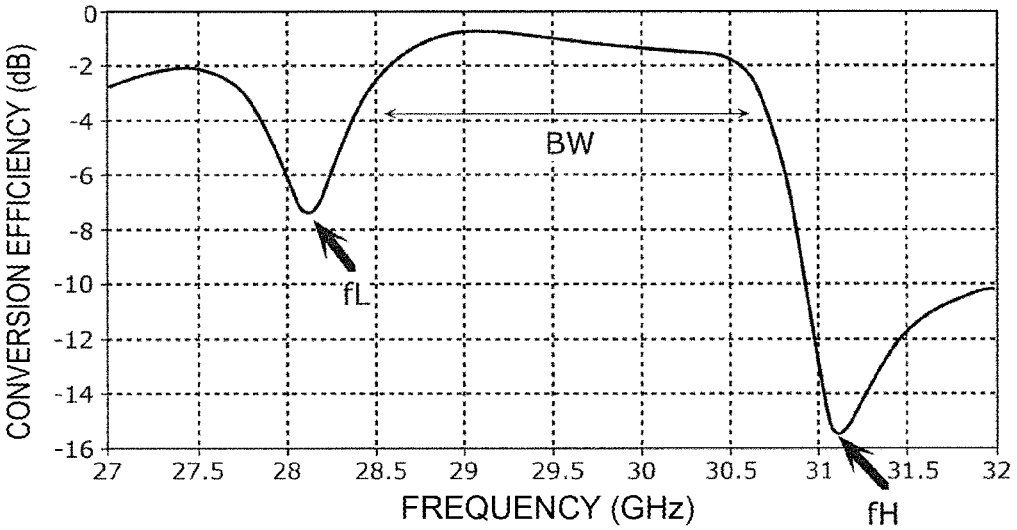
FIG. 5 is a graph illustrating conversion efficiency (antenna gain) of the patch antenna according to the first embodiment.

FIG. 4 is a graph illustrating reflection characteristics of the patch antenna 10 according to the first embodiment. FIG. 5 is a graph illustrating conversion efficiency (antenna gain) of the patch antenna 10 according to the first embodiment. FIG. 4 illustrates the reflection characteristics of the patch antenna 10 when the power feeding point (the connection point between the power feeding conductor pattern 12 and the conductor via 15) of the patch antenna 10 is seen from the connection electrode 16. FIG. 5 illustrates the conversion efficiency (antenna gain) which is a ratio of antenna radiation power relative to power of the radio frequency signal fed from the above-described power feeding point.

As illustrated in FIG. 4, at the resonant frequency f2 defined by the in-phase mode currents flowing through the power feeding conductor pattern 12 and the ground conductor pattern 14, return loss is maximum. In the vicinity of the maximum point of the resonant frequency f2, as described above, radiation from the power feeding conductor pattern 12 in the directions about the Z-axis positive direction is excited.

At the resonant frequency f1 defined by the opposite-phase mode currents flowing through the power feeding conductor pattern 12 and the first parasitic conductor pattern 11, the return loss is maximum. In the vicinity of the maximum point of the resonant frequency f1, as described above, radiation from the first parasitic conductor pattern 11 is suppressed.

At the resonant frequency f3 defined by the opposite-phase mode currents flowing through the power feeding conductor pattern 12 and the second parasitic conductor pattern 13, the return loss is maximum. In the vicinity of the maximum point of the resonant frequency f3, as described above, radiation from the second parasitic conductor pattern 13 is suppressed.

Here, the resonant frequency f1 defined by the opposite-phase mode currents flowing through the power feeding conductor pattern 12 and the first parasitic conductor pattern 11 is higher than the resonant frequency f2 defined by the in-phase mode currents flowing through the power feeding conductor pattern 12 and the ground conductor pattern 14, and the resonant frequency f3 defined by the opposite-phase mode currents flowing through the power feeding conductor pattern 12 and the second parasitic conductor pattern 13 is lower than the resonant frequency f2 defined by the above-described in-phase mode currents.

From the reflection characteristics of the patch antenna 10, which are illustrated in FIG. 4, the frequency characteristics of the conversion efficiency (antenna gain) of the patch antenna 10, which are illustrated in FIG. 5, can be obtained. As illustrated in FIG. 5, at a frequency fH in the vicinity of the resonant frequency f1, the conversion efficiency (antenna gain) is minimum. In addition, at a frequency fL in the vicinity of the resonant frequency f3, the conversion efficiency (antenna gain) is minimum. In a frequency band between the frequencies fL and fH, the conversion efficiency (antenna gain) is increased with the resonant frequency f2 as a center.

In other words, it is possible to obtain antenna gain characteristics having a peak of the conversion efficiency (antenna gain) in the vicinity of the resonant frequency f2 defined by the above-described in-phase mode currents and to provide drops (minimum points) of the conversion efficiency (antenna gain) in the vicinity of the resonant frequencies f1 and f3 defined by the above-described opposite-phase mode currents. Therefore, it becomes possible to provide band pass filter characteristics to the antenna gain of the patch antenna 10, so that radiation of unwanted waves such as spurious waves generated in the vicinity of the resonant frequencies f1 and f3 can be suppressed by the patch antenna 10 itself. Further, it is possible to suppress reception of unwanted waves in a reception band in the vicinity of the resonant frequencies f1 and f3, so that the reception sensitivity of the front end circuit or the antenna module 1 including the patch antennas 10 can be improved. Moreover, since it is not necessary to separately provide a filter circuit required in the front end circuit or the antenna module 1, miniaturization of the front end circuit or the antenna module 1 can be achieved.

Note that although the array antenna 4 is an antenna element including the plurality of patch antennas 10, the plurality of patch antennas 10 may be arrayed in the one-dimensional or two-dimensional manner in the dielectric layer 20 and may share the dielectric layer 20 and share the ground conductor pattern 14.

With this configuration, it is possible to form the array antenna 4 in which the plurality of patch antennas 10 is arranged in the one-dimensional or two-dimensional manner in the same dielectric layer 20. Thus, it is possible to realize a phased array antenna which has a filter function in the antenna gain characteristics and can control directivity with an adjusted phase for each patch antenna 10.

The antenna module according to the disclosure may include the patch antennas 10 and a power feeding circuit that feeds a radio frequency signal to the power feeding conductor pattern 12, the first parasitic conductor pattern 11 may be formed on a first main surface of the dielectric layer 20, the ground conductor pattern 14 may be formed on a second main surface of the dielectric layer 20, which opposes the first main surface, and the power feeding circuit may be formed on the second main surface side of the dielectric layer 20.

Thus, it is possible to suppress radiation of unwanted waves such as spurious waves by the patch antennas 10 themselves. Further, it is possible to suppress reception of unwanted waves in the vicinity of a reception band, so that reception sensitivity of the antenna module can be improved. Moreover, since it is not necessary to separately provide a filter circuit required in the power feeding circuit, miniaturization of the antenna module can be achieved.

The communication apparatus 5 according to the disclosure includes the patch antennas 10 and the RF signal processing circuit 3. The RF signal processing circuit 3 includes the phase shifters 35A to 35D for shifting the phases of the radio frequency signals, the power amplifiers 32AT to 32DT and the low noise amplifiers 32AR to 32DR for amplifying the radio frequency signals, and the switches 31A to 31D for switching connection between the signal paths through which the radio frequency signals propagate and the patch antennas 10.

With this configuration, it is possible to realize the multi-band/multi-mode communication apparatus 5 capable of controlling directivity of antenna gain while suppressing radiation of unwanted waves such as spurious waves and improving reception sensitivity.

Second Embodiment

Each of the patch antennas 10 according to the first embodiment has the configuration in which the power feeding conductor pattern 12 is interposed between the first parasitic conductor pattern 11 and the second parasitic conductor pattern 13, so that the band pass filter function is provided to the antenna radiation characteristics. In contrast, in the embodiment, a patch antenna having a high pass filter circuit in place of the second parasitic conductor pattern 13 will be described.

[2.1 Configuration of Patch Antenna]

Figure 6:
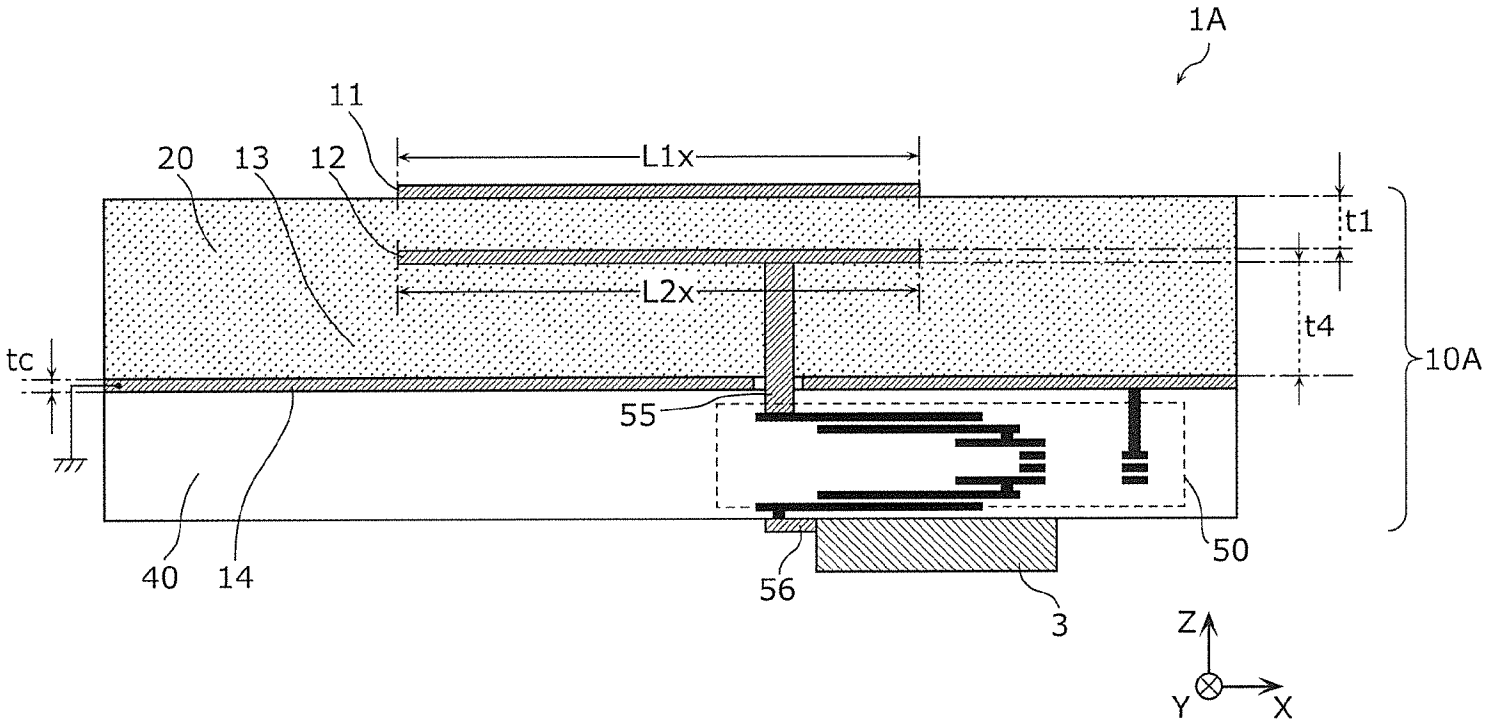
FIG. 6 is a cross-sectional view of a communication apparatus (antenna module) according to a second embodiment.

FIG. 6 is a cross-sectional view of an antenna module 1A according to the second embodiment. FIG. 6 corresponds to a cross-sectional view taken along a line III-III of FIG. 2.

As illustrated in FIG. 6, the antenna module 1A includes a patch antenna 10A and the RF signal processing circuit (RFIC) 3. The patch antenna 10A includes the first parasitic conductor pattern 11, the power feeding conductor pattern 12, the ground conductor pattern 14, a high pass filter circuit 50, the dielectric layer 20, and the substrate 40.

The patch antenna 10A according to the embodiment is different from the patch antenna 10 according to the first embodiment in that it has the high pass filter circuit 50 instead of the second parasitic conductor pattern 13. Hereinafter, points of the patch antenna 10A, which are different from those of the patch antenna 10 according to first embodiment, will be mainly described while omitting the same points.

As illustrated in FIG. 6, the power feeding conductor pattern 12 is a conductor pattern that is formed in the dielectric layer 20 so as to be substantially parallel to the main surface of the dielectric layer 20, and a radio frequency signal is fed thereto from the RF signal processing circuit (RFIC) 3 after passing through the high pass filter circuit 50 and a conductor via 55.

The first parasitic conductor pattern 11 is a conductor pattern that is formed on the dielectric layer 20 so as to be substantially parallel to the main surface of the dielectric layer 20, to which no radio frequency signal is supplied, and that is not set to have a ground potential.

The first parasitic conductor pattern 11, the power feeding conductor pattern 12, and the ground conductor pattern 14 are arranged in this order when the dielectric layer 20 is seen in a cross section (see FIG. 6), and the adjacent conductor patterns overlap each other when the dielectric layer 20 is seen in a plan view.

The dielectric layer 20 has a laminated structure that is filled with a dielectric material between the first parasitic conductor pattern 11 and the power feeding conductor pattern 12 and between the power feeding conductor pattern 12 and the ground conductor pattern 14. Note that the dielectric layer 20 may be, for example, an LTCC substrate, a printed substrate, or the like. The dielectric layer 20 may be simply a space that is not filled with the dielectric material. In this case, a structure for supporting the first parasitic conductor pattern 11 and the power feeding conductor pattern 12 is required.

As illustrated in FIG. 6, the ground conductor pattern 14 is arranged on a first main surface (surface) of the substrate 40, and the RF signal processing circuit (RFIC) 3 and a connection electrode 56 are arranged on a second main surface (back surface) of the substrate 40, which opposes the first main surface (surface). The conductor via 55 that connects the RF signal processing circuit (RFIC) 3 and the power feeding conductor pattern 12 and the high-pass filter circuit 50 are formed inside the substrate 40. In view of formation of the high pass filter circuit 50, the substrate 40 can be a multilayer ceramic substrate, for example, but may be a resin substrate, a printed substrate, or the like.

Table 2 indicates dimensions and material parameters of the elements forming the patch antenna 10A according to the embodiment. In Table 2, only an interval t4 between the power feeding conductor pattern 12 and the ground conductor pattern 14 is different from the first embodiment (Table 1).

TABLE 2

| | |
|---|---|
| POWER FEEDING CONDUCTOR PATTERN 12 LENGTH L2x (mm), WIDTH L2y (mm) | 2.51 |
| FIRST PARASITIC CONDUCTOR PATTERN 11 LENGTH L1x (mm), WIDTH L1y (mm) | 2.51 |
| GROUND CONDUCTOR PATTERN 14 LENGTH (mm), WIDTH (mm) | 10 |
| THICKNESS tc (μm) OF EACH CONDUCTOR PATTERN | 10 |
| INTERVAL t1 (mm) BETWEEN FIRST PARASITIC CONDUCTOR PATTERN 11 AND POWER FEEDING CONDUCTOR PATTERN 12 | 0.14 |
| INTERVAL t3 (mm) BETWEEN POWER FEEDING CONDUCTOR PATTERN 12 AND GROUND CONDUCTOR PATTERN 13 | 0.25 |
| RELATIVE PERMITTIVITY εr OF DIELECTRIC LAYER 20 | 3.5 |
| DIELECTRIC LOSS TANGENT tanδ OF DIELECTRIC LAYER 20 | 0.004 |

In the patch antenna 10A, a power feeding point of the radio frequency signal, that is, a connection point between the conductor via 55 and the power feeding conductor pattern 12 deviates from a center point of the power feeding conductor pattern 12 in an X-axis direction. Therefore, the polarization direction of the patch antenna 10A is the X-axis direction.

The high pass filter circuit 50 is a high pass filter circuit that is formed on a power feeding line for transmitting the radio frequency signal to the power feeding conductor pattern 12. In this embodiment, a transmission line in the substrate 40 connected to the connection electrode 56 and the conductor via 55 corresponds to the above-described power feeding line.

Figure 7A:
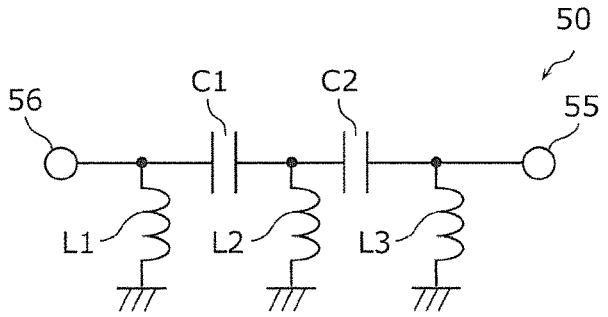
FIG. 7A is a circuit diagram of a high pass filter circuit according to the second embodiment.

FIG. 7A is a circuit diagram of the high pass filter circuit 50 according to the second embodiment. The high pass filter circuit 50 has capacitors C1 and C2 connected in series with each other on a path connecting the conductor via 55 and the connection electrode 56, and inductors L1, L2 and L3 connected between nodes and ground on the path. The capacitors C1 and C2 and the inductors L1 to L3 are formed by conductor patterns arranged in the substrate 40. Note that FIG. 6 illustrates an example in which the planar coil pattern, the parallel plate electrode pattern, and the like are formed in the multilayer ceramic substrate, but the disclosure is not limited thereto. As a frequency band increases from microwave bands to millimeter wave bands, an inductor component may be realized only by the transmission line and gaps having a comb-like shape, or the like may be provided in the transmission line to realize a capacitor component.

Figure 7B:
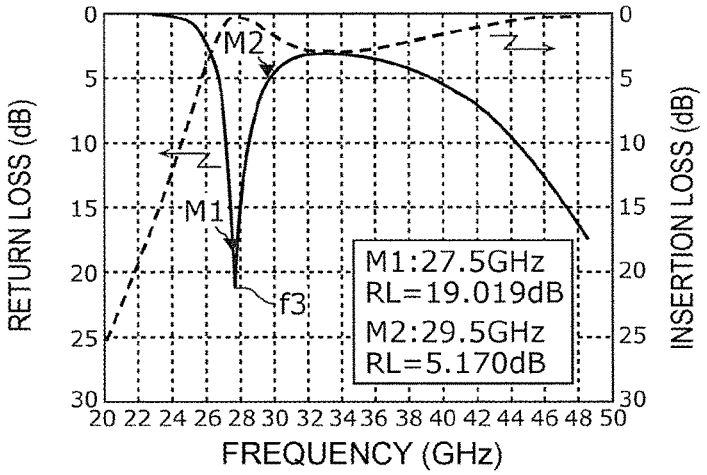
FIG. 7B is a graph illustrating reflection characteristics and bandpass characteristics of the high pass filter circuit according to the second embodiment.

FIG. 7B is a graph illustrating reflection characteristics and bandpass characteristics of the high pass filter circuit 50 according to the second embodiment. In this figure, the bandpass characteristics and the reflection characteristics of the high pass filter circuit 50 alone are illustrated. As illustrated in FIG. 7B, the high-pass filter circuit 50 has high pass filter characteristics that the vicinity of 26 GHz is set at a cutoff frequency (a frequency degraded by 3 dB from a minimum point of insertion loss). There is a resonant frequency f3 at which the return loss is maximum in the vicinity of this cutoff frequency. Here, the cutoff frequency of the high pass filter circuit 50 is lower than the above-described resonant frequency f2 defined by the in-phase mode currents.

Table 3 indicates circuit constants of the high pass filter circuit 50 which realizes the filter characteristics of FIG. 7B.

TABLE 3

| | |
|---|---|
| CAPACITOR C1 (pF) | 0.12 |
| CAPACITOR C2 (pF) | 0.11 |
| INDUCTOR L1 (nH) | 0.1 |
| INDUCTOR L2 (nH) | 0.1 |
| INDUCTOR L3 (nH) | 0.12 |

Note that the filter characteristics illustrated in FIG. 7A are not optimized as the filter characteristics of the high pass filter circuit 50 alone. The filter characteristics of the high pass filter circuit 50 are adjusted so as to be optimized when it is combined with the patch antenna 10A. Therefore, the cutoff frequency of the high pass filter circuit 50, the resonant frequency f3 at which the return loss is maximum, the insertion loss of the pass band, and the like change depending on a matching state when the high pass filter circuit 50 is combined with the patch antenna 10A.

In the patch antenna 10A having the above configuration, when the radio frequency signal is fed from the RF signal processing circuit (RFIC) 3 to the power feeding conductor pattern 12, the in-phase radio frequency currents flow through the power feeding conductor pattern 12 and the ground conductor pattern 14. The radio frequency signal having the resonant frequency f2 defined by this in-phase mode radio frequency currents and the length L2*x* of the power feeding conductor pattern 12 in the polarization direction (X-axis direction) is radiated from the power feeding conductor pattern 12 in directions about a Z-axis positive direction.

When the radio frequency signal is fed from the RF signal processing circuit (RFIC) 3 to the power feeding conductor pattern 12, a radio frequency current of a phase opposite to that of the power feeding conductor pattern 12 flows through the first parasitic conductor pattern 11. In the vicinity of the resonant frequency f1 defined by this opposite-phase mode radio frequency current and the length L1*x* of the first parasitic conductor pattern 11 in the polarization direction (X-axis direction), radiation from the first parasitic conductor pattern 11 is suppressed.

In the patch antenna 10A according to the embodiment, the electric length (2×L2*x*) of the feeding conductor pattern 12 in the polarization direction (X-axis direction) is equal to or larger than (the same as) the electric length (2×L1*x*) of the first parasitic conductor pattern 11 in the polarization direction (X-axis direction).

Thus, the resonant frequency f2 defined by the electric length (2×L2*x*) of the power feeding conductor pattern 12 in the polarization direction (X-axis direction) is lower than the resonant frequency f1 defined by the electric length (2×L1$x$) of the first parasitic conductor pattern 11 in the polarization direction (X-axis direction).

The cutoff frequency of the high pass filter circuit 50 is set to be lower than the resonant frequency f2 defined by the electric length (2×L2$x$) of the power feeding conductor pattern 12 in the polarization direction (X-axis direction). Therefore, it is possible to provide band pass filter characteristics to antenna gain. This will be described in detail below with reference to the reflection characteristics of the patch antenna 10A.

[2.2 Reflection Characteristics of Patch Antenna]

Figure 8:
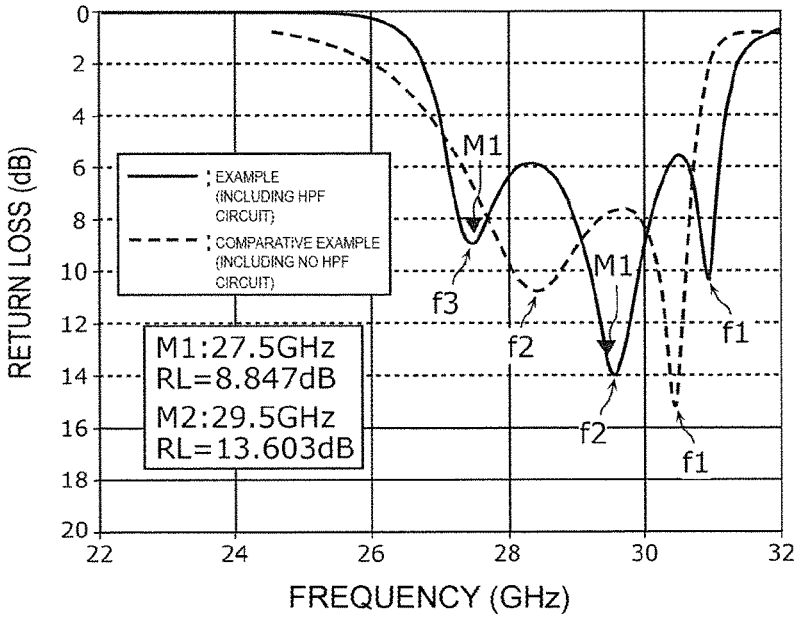
FIG. 8 is a graph comparing reflection characteristics of patch antennas according to the second embodiment (example) and a comparative example.

FIG. 8 is a graph comparing reflection characteristics of patch antennas according to the second embodiment (example) and a comparative example. FIG. 8 illustrates the reflection characteristics of the patch antennas when the power feeding point (the connection point between the power feeding conductor pattern 12 and the conductor via 55) of each patch antenna is seen from the connection electrode 56. In FIG. 8, the reflection characteristics (solid curve) of the example are the reflection characteristics of the patch antenna 10A having the high pass filter circuit 50, and the reflection characteristics (broken curve) of the comparative example are the reflection characteristics of the patch antenna in which the high pass filter circuit 50 is eliminated from the patch antenna 10A.

As illustrated in FIG. 8, in both of the patch antenna 10A according to the example and the patch antenna according to the comparative example, return loss is maximum at the resonant frequency f2 defined by the in-phase mode currents flowing through the power feeding conductor pattern 12 and the ground conductor pattern 14. In the vicinity of the maximum point of the resonant frequency f2, as described above, radiation from the power feeding conductor pattern 12 in the directions about the Z-axis positive direction is excited.

Further, in both of the patch antenna 10A according to the example and the patch antenna according to the comparative example, the return loss is maximum at the resonant frequency f1 defined by the opposite-phase mode currents flowing through the power feeding conductor pattern 12 and the first parasitic conductor pattern 11. In the vicinity of the maximum point of the resonant frequency f1, as described above, radiation from the first parasitic conductor pattern 11 is suppressed.

Further, in the patch antenna 10A according to the embodiment, at the resonant frequency f3, which is an attenuation pole defined by the high pass filter circuit 50, the return loss is maximum. This resonant frequency f3 is located in the vicinity of the cutoff frequency of the high pass filter circuit 50. At frequencies equal to or lower than the vicinity of the maximum point of the resonant frequency f3, as described above, radiation from the power feeding conductor pattern 12 is suppressed.

In the patch antenna according to the comparative example, since the high-pass filter circuit 50 is not provided, the maximum point of the return loss corresponding to the resonant frequency f3 is not generated on the low frequency side of the resonant frequency f2. For this reason, it is not possible to provide the band pass filter characteristics to the antenna gain of the patch antenna. Thus, it is not possible to suppress the radiation of unwanted waves generated on the low frequency side of the resonant frequency f2 by the patch antenna itself.

In the patch antenna 10A according to the example, the vicinity of the resonant frequency f1 defined by the opposite-phase mode currents flowing through the power feeding conductor pattern 12 and the first parasitic conductor pattern 11 is higher than the resonant frequency f2 defined by the in-phase mode currents flowing through the power feeding conductor pattern 12 and the ground conductor pattern 14, and the cutoff frequency defined by the high pass filter circuit 50 is lower than the resonant frequency f2 defined by the in-phase mode currents.

From the reflection characteristics of the patch antenna 10A according to the example illustrated in FIG. 8, it can be seen that the frequency characteristics of the conversion efficiency (antenna gain) of the patch antenna 10A have a band pass filter function.

In other words, it is possible to obtain characteristics having a peak of the antenna gain in the vicinity of the resonant frequency f2 defined by the in-phase mode currents and to provide minimum points of the conversion efficiency (antenna gain) in the vicinity of the resonant frequency f1 defined by the opposite-phase mode currents and the resonant frequency f3 defined by the high-pass filter circuit 50. Therefore, it becomes possible to provide the band pass filter characteristics to the antenna gain of the patch antenna 10A, so that radiation of unwanted waves such as spurious waves generated in the vicinity of the resonant frequencies f1 and f3 can be suppressed by the patch antenna 10A itself. Further, it is possible to suppress reception of unwanted waves in reception bands in the vicinity of the resonant frequencies f1 and f3, so that the reception sensitivity of the front end circuit or the antenna module 1A including the patch antenna 10A can be improved. Moreover, since it is not necessary to separately provide a filter circuit required in the front end circuit or the antenna module 1A, miniaturization of the front end circuit or the antenna module 1A can be achieved.

Other Embodiments

While the antenna element, the antenna module, and the communication apparatus according to the embodiments of the disclosure have been described above with reference to the first embodiment and the second embodiment, the antenna element, the antenna module, and the communication apparatus according to the disclosure are not limited to the above-described embodiments. Other embodiments which are realized by combining desired components in the above-described embodiments, variations which can be obtained by performing, on the above-described embodiments, various modifications that those skilled in the art can suppose without departing from the spirit of the disclosure, various apparatuses incorporating the antenna element, the antenna module, and the communication apparatus of the present disclosure are also encompassed in the disclosure.

For example, the antenna element according to the disclosure may include a so-called notch antenna or a dipole antenna in addition to the patch antenna described in the above embodiments.

Figure 9A:
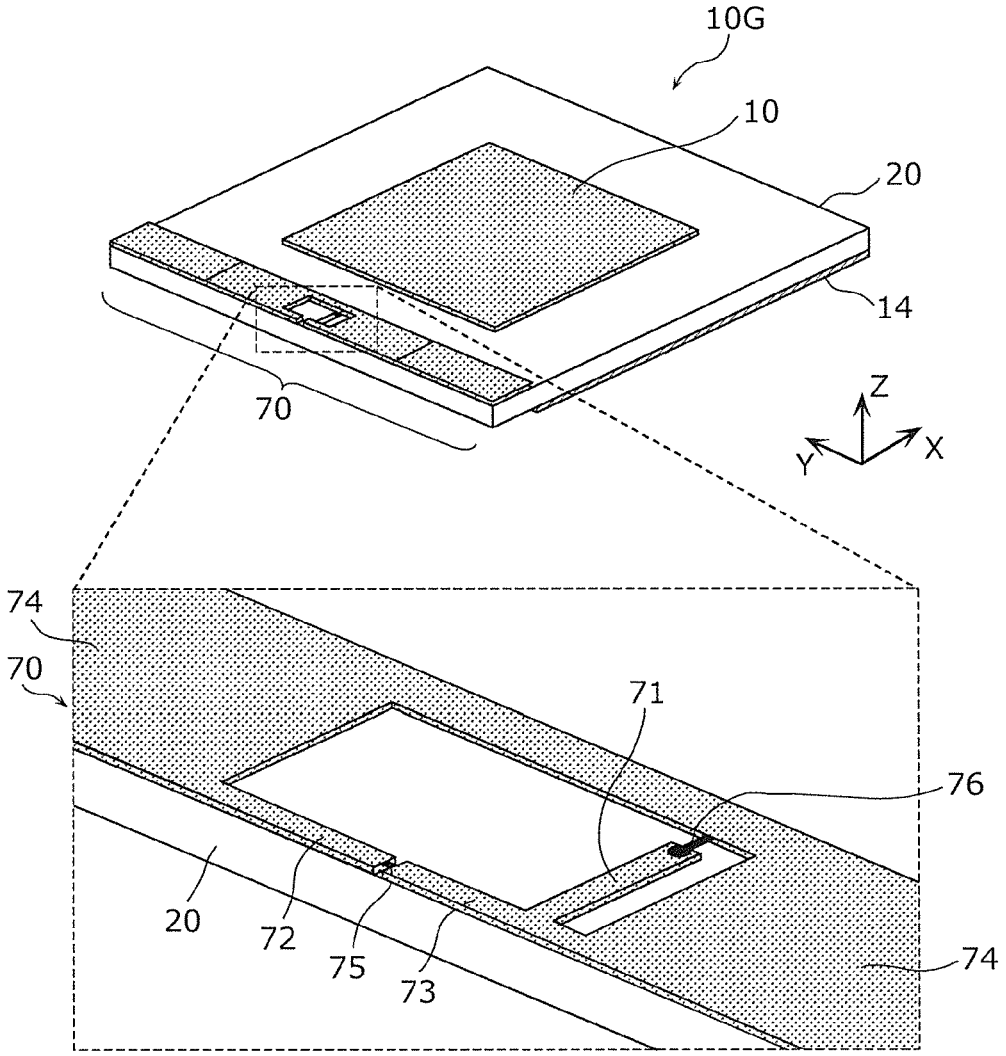
FIG. 9A is a perspective view illustrating an outer appearance of an antenna element according to another embodiment.

FIG. 9A is a perspective view illustrating an outer appearance of an antenna 10G according to another embodiment. The antenna 10G illustrated in FIG. 9A includes the patch antenna 10 and a notch antenna 70. The patch antenna 10 or 10A according to any one of the above-described embodiments is applied to the patch antenna 10. The notch antenna 70 is formed in an outer peripheral portion of the patch antenna 10. More specifically, conductor patterns of the notch antenna 70 are formed on the surface of the dielectric layer 20 (the surface on which the first parasitic conductor pattern is formed). As an example, as illustrated in FIG. 9A, the notch antenna 70 is arranged at an end side of the antenna 10G, which intersects with the polarization direction (X-axis direction) of the patch antenna 10. Note that the conductor patterns of the notch antenna 70 may be formed inside the dielectric layer 20.

The notch antenna 70 includes a planar ground conductor pattern 74 (second ground conductor pattern) formed on the surface, a ground non-formation region interposed between portions of the ground conductor pattern 74, radiation electrodes 72 and 73 arranged on the surface in the ground non-formation region, a power feeding line 71, and capacitive elements 75 and 76. A radio frequency signal fed to the power feeding line 71 is radiated from the radiation electrodes 72 and 73. While the patch antenna 10 has directivity in the zenith direction (elevation direction: the vertical upward direction of the dielectric layer 20), the notch antenna 70 has directivity from a center portion of the antenna 10G in the direction in which the notch antenna 70 is arranged (i.e., in the azimuth direction: Y-axis negative direction). No ground conductor pattern can be formed in a region of the back surface of the dielectric layer 20, which opposes the ground conductor pattern 74 and the ground non-formation region.

With the above configuration, since the notch antenna 70 is formed, the ground conductor pattern 74 is formed, so that heat radiation efficiency is increased. Further, by combining the notch antenna 70 and the patch antenna 10, it is possible to support different frequency bands, so that a multi-band antenna can be easily designed. Moreover, since the area of the ground conductor pattern of the notch antenna 70 may be smaller than that of the dipole antenna, it is advantageous in that the miniaturization of the area is obtained.

Figure 9B:
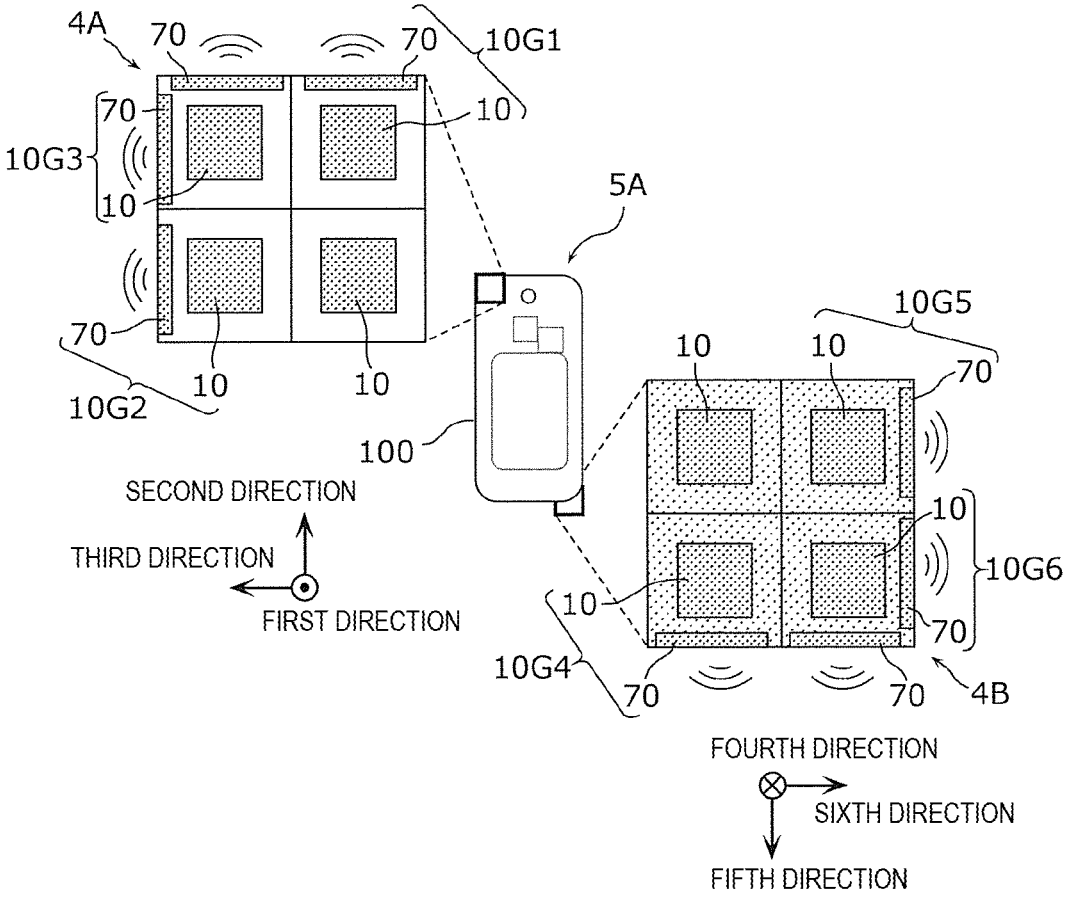
FIG. 9B is a schematic view of a mobile terminal in which the antenna elements according to another embodiment are arranged.

FIG. 9B is a schematic diagram of a mobile terminal 5A in which the antennas 10G are arranged. FIG. 9B illustrates the mobile terminal 5A and array antennas 4A and 4B arranged in the mobile terminal 5A. In addition to the array antennas 4A and 4B, an RF signal processing circuit that feeds a radio frequency signal to the array antennas 4A and 4B is arranged in the mobile terminal 5A.

As illustrated in FIG. 9B, the mobile terminal 5A includes the array antennas 4A and 4B and a housing 100 in which the RF signal processing circuit is arranged. The housing 100 is a hexahedron having a first outer peripheral surface as a main surface (e.g., a surface on which an operation panel is arranged), a second outer peripheral surface opposing the first outer peripheral surface, a third outer peripheral surface (e.g., an upper side surface in FIG. 9B) perpendicular to the first outer peripheral surface, a fourth outer peripheral surface (e.g., a lower side surface in FIG. 9B) opposing the third outer peripheral surface, a fifth outer peripheral surface (e.g., a left side surface in FIG. 9B) perpendicular to the first outer peripheral surface and the third outer peripheral surface, and a sixth outer peripheral surface (e.g., a right side surface in FIG. 9B) opposing the fifth outer peripheral surface. Note that the housing 100 may not be a rectangular parallelepiped having the above six surfaces. It is sufficient that the housing 100 is a polyhedron having six surfaces, and corner portions in which the above six surfaces contact with each other may be rounded.

The array antenna 4A (first array antenna) includes antennas 10G1, 10G2, 10G3, and the patch antennas 10 that are arrayed in a two-dimensional manner. The array antenna 4B (second array antenna) includes antennas 10G4, 10G5, 10G6, and the patch antennas 10 that are arrayed in a two-dimensional manner.

The antenna 10G1 is an example of the antenna 10G in which one patch antenna 10 and one notch antenna 70 are arranged, and is a first antenna element arranged such that a direction from the ground conductor pattern 14 toward the power feeding conductor pattern 12 coincides with a first direction from the second outer peripheral surface toward the first outer peripheral surface, and a direction from the power feeding conductor pattern 12 toward the notch antenna 70 coincides with a second direction from the fourth outer peripheral surface toward the third outer peripheral surface.

The antenna 10G2 is an example of the antenna 10G in which one patch antenna 10 and one notch antenna 70 are arranged, and is a second antenna element arranged such that the direction from the ground conductor pattern 14 toward the power feeding conductor pattern 12 coincides with the first direction, and the direction from the power feeding conductor pattern 12 toward the notch antenna 70 coincides with a third direction from the sixth outer peripheral surface toward the fifth outer peripheral surface.

The antenna 10G3 is an example of the antenna 10G in which one patch antenna 10 and two notch antennas 70 are arranged, and is an antenna element arranged such that the direction from the ground conductor pattern 14 toward the power feeding conductor pattern 12 coincides with the first direction, a direction from the power feeding conductor pattern 12 toward one notch antenna 70 coincides with the second direction, and a direction from the power feeding conductor pattern 12 toward the other notch antenna 70 coincides with the third direction.

The antenna 10G4 is an example of the antenna 10G in which one patch antenna 10 and one notch antenna 70 are arranged, and is a third antenna element arranged such that the direction from the ground conductor pattern 14 toward the power feeding conductor pattern 12 coincides with a fourth direction from the first outer peripheral surface toward the second outer peripheral surface, and the direction from the power feeding conductor pattern 12 toward the notch antenna 70 coincides with a fifth direction from the third outer peripheral surface toward the fourth outer peripheral surface.

The antenna 10G5 is an example of the antenna 10G in which one patch antenna 10 and one notch antenna 70 are arranged, and is a fourth antenna element arranged such that the direction from the ground conductor pattern 14 toward the power feeding conductor pattern 12 coincides with the fourth direction, and the direction from the power feeding conductor pattern 12 toward the notch antenna 70 coincides with a six direction from the fifth outer peripheral surface toward the sixth outer peripheral surface.

The antenna 10G6 is an example of the antenna 10G in which one patch antenna 10 and two notch antennas 70 are arranged, and is an antenna element arranged such that the direction from the ground conductor pattern 14 toward the power feeding conductor pattern 12 coincides with the fourth direction, the direction from the power feeding conductor pattern 12 toward one notch antenna 70 coincides with the fifth direction, and the direction from the power feeding conductor pattern 12 to the other notch antenna 70 coincides with the sixth direction.

In FIG. 9B, since the array antenna 4B is arranged on the second outer peripheral surface side which is the back surface of the housing 100 of the mobile terminal 5A, an enlarged view of the array antenna 4B is illustrated as a plan see-through view.

With the above configuration, as illustrated in FIG. 9B, for example, the array antenna 4A is arranged on the upper left surface side of the mobile terminal 5A and the array antenna 4B is arranged on the lower right back surface side of the mobile terminal 5A. At this time, the array antenna 4A arranged on the upper left surface side has directivity in the vertical line upward direction (first direction) of the surface of the mobile terminal and the horizontal line direction (second direction and third direction) of the surface of the mobile terminal. Further, the array antenna 4B arranged on the lower right back surface side has directivity in the vertical line downward direction (fourth direction) of the surface of the mobile terminal and the horizontal line direction (fifth direction and sixth direction) of the surface of the mobile terminal. Thus, it is possible to provide the directivity in all directions of the mobile terminal 5A.

In the above configuration of the mobile terminal 5A, for example, the sizes of the array antennas 4A and 4B were set to 11 mm (widths in the second direction and the fifth direction)×11 mm (widths in the third direction and the sixth direction)×0.87 mm (thicknesses in the first direction and the fourth direction), and the directivity of the gain was examined. Note that the size of the ground substrate on which the array antennas 4A and 4B are arranged was set to 140 mm (width)×70 (width) mm. In this case, in each of the array antenna 4A and the array antenna 4B, peak gain of equal to or higher than 10 dBi was obtained in the first direction or the fourth direction from the four elements of the patch antennas 10. On the other hand, peak gain of 5 dBi was obtained in the second direction, the third direction, the fifth direction, or the sixth direction from two elements of the notch antennas 70 arranged in the same direction (side). Thus, it is possible to configure diversity in which the best is selected from (1) the four elements of the patch antennas 10 (both polarization), (2) a first group of the notch antennas 70 arranged in the same direction (side), and (3) a second group of the notch antennas 70 arranged in the same direction (side), which are arranged perpendicularly to the notch antennas 70 of the first group. When diversity communication using the array antennas 4A and 4B is performed, it is possible to obtain antenna characteristics in which a ratio of equal to or higher than 6 dBi on all spherical surfaces exceeds 80%.

For example, the patch antennas according to the first embodiment and the second embodiment can be applied to a Massive MIMO system. One promising wireless transmission technology of 5G (fifth generation mobile communication system) is a combination of a phantom cell and the Massive MIMO system. The phantom cell is a network configuration that isolates a control signal for ensuring stability of communication between a macrocell of a low frequency band and a small cell of a high frequency band and a data signal that is an object of high-speed data communication. Each phantom cell is provided with a Massive MIMO antenna device. The Massive MIMO system is technology for improving transmission quality in a millimeter wave band or the like, and controls directivity of patch antennas by controlling signals transmitted from the patch antennas. Also, since the Massive MIMO system uses a large number of patch antennas, it is possible to generate beams with sharp directivity. By increasing the directivity of beams, radio waves can be emitted to a certain extent even in a high frequency band, and interference between the cells can be reduced to enhance the frequency utilization efficiency.

INDUSTRIAL APPLICABILITY

The present disclosure is widely applicable to communication apparatuses for the millimeter wave band mobile communication system, the Massive MIMO system, and the like as the antenna element having the band pass filter function.

REFERENCE SIGNS LIST

1, 1A ANTENNA MODULE
2 BASE BAND SIGNAL PROCESSING CIRCUIT (BBIC)
3 RF SIGNAL PROCESSING CIRCUIT (RFIC)
4, 4A, 4B ARRAY ANTENNA
5 COMMUNICATION APPARATUS
5A MOBILE TERMINAL
10, 10A PATCH ANTENNA
10G, 10G1, 10G2, 10G3, 10G4, 10G5, 10G6 ANTENNA
11 FIRST PARASITIC CONDUCTOR PATTERN
12 POWER FEEDING CONDUCTOR PATTERN
13 SECOND PARASITIC CONDUCTOR PATTERN
14, 74 GROUND CONDUCTOR PATTERN
15, 55 CONDUCTOR VIA
16, 56 CONNECTION ELECTRODE
20 DIELECTRIC LAYER
31A, 31B, 31C, 31D, 33A, 33B, 33C, 33D, 37 SWITCH
32AR, 32BR, 32CR, 32DR LOW NOISE AMPLIFIER
32AT, 32BT, 32CT, 32DT POWER AMPLIFIER
34A, 34B, 34C, 34D ATTENUATOR
35A, 35B, 35C, 35D PHASE SHIFTER
36 SIGNAL MULTIPLEXER/DEMULTIPLEXER
38 MIXER
39 AMPLIFIER CIRCUIT
40 SUBSTRATE
50 HIGH PASS FILTER CIRCUIT
70 NOTCH ANTENNA
71 POWER FEEDING LINE
72, 73 RADIATION ELECTRODE
75, 76 CAPACITIVE ELEMENT

The invention claimed is:

1. An antenna element comprising:

a dielectric layer;

a planar power feeding conductor pattern provided in the dielectric layer, wherein a radio frequency signal is fed to the planar power feeding conductor pattern;

a planar first ground conductor pattern provided on the dielectric layer so as to face the power feeding conductor pattern, the planar first ground conductor pattern being set to have a ground potential;

a planar first parasitic conductor pattern provided on the dielectric layer so as to face the power feeding conductor pattern, wherein no radio frequency signal is fed to the planar first parasitic conductor pattern, and the planar first parasitic conductor pattern is set to not have the ground potential; and a planar second parasitic conductor pattern provided in the dielectric layer so as to face the power feeding conductor pattern, wherein no radio frequency signal is fed to the planar second parasitic conductor pattern, and the planar second parasitic conductor pattern is set to not have the ground potential, wherein the first parasitic conductor pattern, the power feeding conductor pattern, the second parasitic conductor pattern, and the first ground conductor pattern are arranged in this order when the dielectric layer is seen in a cross section and overlap each other when the dielectric layer is seen in a plan view, a resonant frequency defined by opposite-phase mode currents flowing through the power feeding conductor pattern and the first parasitic conductor pattern is higher than a resonant frequency defined by in-phase mode currents flowing through the power feeding conductor pattern and the first ground conductor pattern, and a resonant frequency defined by opposite-phase mode currents flowing through the power feeding conductor pattern and the second parasitic conductor pattern is lower than the resonant frequency defined by the in-phase mode currents.

2. The antenna element according to claim 1, wherein an electric length of the power feeding conductor pattern in a polarization direction is equal to or larger than an electric length of the first parasitic conductor pattern in the polarization direction and equal to or smaller than an electric length of the second parasitic conductor pattern in the polarization direction.

3. The antenna element according to claim 1, further comprising a notch antenna provided on a surface of the dielectric layer or inside the dielectric layer and on an outer peripheral portion of the power feeding conductor pattern in the plan view, wherein the notch antenna includes:

a planar second ground conductor pattern provided on the surface of the dielectric layer;

a ground non-formation region interposed between portions of the second ground conductor pattern;

a radiation electrode provided on the surface in the ground non-formation region; and a capacitive element arranged in the ground non-formation region and connected to the radiation electrode.

4. A communication apparatus comprising:

a first array antenna and a second array antenna;

an RF signal processing circuit that feeds a radio frequency signal to a power feeding conductor pattern; and a housing in which the first array antenna, the second array antenna, and the RF signal processing circuit are arranged, wherein the housing is a hexahedron having a first outer peripheral surface as a main surface, a second outer peripheral surface opposing the first outer peripheral surface, a third outer peripheral surface perpendicular to the first outer peripheral surface, a fourth outer peripheral surface opposing the third outer peripheral surface, a fifth outer peripheral surface perpendicular to the first outer peripheral surface and the third outer peripheral surface, and a sixth outer peripheral surface opposing the fifth outer peripheral surface, wherein the first array antenna includes:

a first antenna element according to claim 3, which is arranged such that a direction from the first ground conductor pattern toward the power feeding conductor pattern coincides with a first direction from the second outer peripheral surface toward the first outer peripheral surface and a direction from the power feeding conductor pattern toward the notch antenna coincides with a second direction from the fourth outer peripheral surface toward the third outer peripheral surface; and a second antenna element according to claim 3, which is arranged such that the direction from the first ground conductor pattern toward the power feeding conductor pattern coincides with the first direction and the direction from the power feeding conductor pattern toward the notch antenna coincides with a third direction from the sixth outer peripheral surface toward the fifth outer peripheral surface, and wherein the second array antenna includes:

a third antenna element according to claim 3, which is arranged such that the direction from the first ground conductor pattern toward the power feeding conductor pattern coincides with a fourth direction from the first outer peripheral surface toward the second outer peripheral surface and the direction from the power feeding conductor pattern toward the notch antenna coincides with a fifth direction from the third outer peripheral surface toward the fourth outer peripheral surface; and a fourth antenna element according to claim 3, which is arranged such that the direction from the first ground conductor pattern toward the power feeding conductor pattern coincides with the fourth direction and the direction from the power feeding conductor pattern toward the notch antenna coincides with a sixth direction from the fifth outer peripheral surface toward the sixth outer peripheral surface.

5. The antenna element according to claim 3, wherein the planar second ground conductor pattern is provided inside the dielectric layer.

6. The antenna element according to claim 3, wherein the notch antenna is provided at an end side of the dielectric layer which intersects with the polarization direction.

7. The antenna element according to claim 1, including a plurality of antenna elements arrayed in a one-dimensional or two-dimensional manner, wherein the plurality of antenna elements share the dielectric layer and the first ground conductor pattern.

8. An antenna module comprising:

the antenna element according to claim 1; and a power feeding circuit that feeds the radio frequency signal to the power feeding conductor pattern, wherein the first parasitic conductor pattern is provided on a first main surface of the dielectric layer, the first ground conductor pattern is provided on a second main surface of the dielectric layer, which opposes the first main surface, and the power feeding circuit is provided on the second main surface side of the dielectric layer.

9. A communication apparatus comprising:

the antenna element according to claim 1; and an RF signal processing circuit that feeds the radio frequency signal to the power feeding conductor pattern, wherein the RF signal processing circuit includes:

a phase shift circuit shifting a phase of the radio frequency signal;

an amplifying circuit amplifying the radio frequency signal; and a switch element switching connection between a signal path through which the high-frequency signal propagates and the antenna element.

10. An antenna element comprising:

a dielectric layer;

a planar power feeding conductor pattern provided in the dielectric layer, wherein a radio frequency signal is fed to the planar power feeding conductor pattern;

a planar first ground conductor pattern provided on the dielectric layer so as to face the power feeding conductor pattern, the planar first ground conductor pattern being set to have a ground potential;

a planar first parasitic conductor pattern provided on the dielectric layer so as to face the power feeding conductor pattern, wherein no radio frequency signal is fed to the planar first parasitic conductor pattern, and the planar first parasitic conductor pattern is set to not have the ground potential; and a high pass filter circuit provided on a power feeding line for transmitting the radio frequency signal to the power feeding conductor pattern, wherein the first parasitic conductor pattern, the power feeding conductor pattern, and the first ground conductor pattern are arranged in this order when the dielectric layer is seen in a cross section and overlap each other when the dielectric layer is seen in a plan view, a resonant frequency defined by opposite-phase mode currents flowing through the power feeding conductor pattern and the first parasitic conductor pattern is higher than a resonant frequency defined by in-phase mode currents flowing through the power feeding conductor pattern and the first ground conductor pattern, and a cutoff frequency of the high pass filter circuit is lower than the resonant frequency defined by the in-phase mode currents.

11. The antenna element according to claim 10, wherein an electric length of the power feeding conductor pattern in a polarization direction is equal to or larger than an electric length of the first parasitic conductor pattern in the polarization direction.

12. The antenna element according to claim 10, further comprising a notch antenna provided on a surface of the dielectric layer or inside the dielectric layer and on an outer peripheral portion of the power feeding conductor pattern in the plan view, wherein the notch antenna includes:

a planar second ground conductor pattern provided on the surface;

a ground non-formation region interposed between portions of the second ground conductor pattern;

a radiation electrode provided on the surface in the ground non-formation region; and a capacitive element arranged in the ground non-formation region and connected to the radiation electrode.

13. A communication apparatus comprising:

a first array antenna and a second array antenna;

an RF signal processing circuit that feeds a radio frequency signal to a power feeding conductor pattern; and a housing in which the first array antenna, the second array antenna, and the RF signal processing circuit are arranged, wherein the housing is a hexahedron having a first outer peripheral surface as a main surface, a second outer peripheral surface opposing the first outer peripheral surface, a third outer peripheral surface perpendicular to the first outer peripheral surface, a fourth outer peripheral surface opposing the third outer peripheral surface, a fifth outer peripheral surface perpendicular to the first outer peripheral surface and the third outer peripheral surface, and a sixth outer peripheral surface opposing the fifth outer peripheral surface, wherein the first array antenna includes:

a first antenna element according to claim 12, which is arranged such that a direction from the first ground conductor pattern toward the power feeding conductor pattern coincides with a first direction from the second outer peripheral surface toward the first outer peripheral surface and a direction from the power feeding conductor pattern toward the notch antenna coincides with a second direction from the fourth outer peripheral surface toward the third outer peripheral surface; and a second antenna element according to claim 12, which is arranged such that the direction from the first ground conductor pattern toward the power feeding conductor pattern coincides with the first direction and the direction from the power feeding conductor pattern toward the notch antenna coincides with a third direction from the sixth outer peripheral surface toward the fifth outer peripheral surface, and wherein the second array antenna includes:

a third antenna element according to claim 12, which is arranged such that the direction from the first ground conductor pattern toward the power feeding conductor pattern coincides with a fourth direction from the first outer peripheral surface toward the second outer peripheral surface and the direction from the power feeding conductor pattern toward the notch antenna coincides with a fifth direction from the third outer peripheral surface toward the fourth outer peripheral surface; and a fourth antenna element according to claim 12, which is arranged such that the direction from the first ground conductor pattern toward the power feeding conductor pattern coincides with the fourth direction and the direction from the power feeding conductor pattern toward the notch antenna coincides with a sixth direction from the fifth outer peripheral surface toward the sixth outer peripheral surface.

14. The antenna element according to claim 12, wherein the planar second ground conductor pattern is provided inside the dielectric layer.

15. The antenna element according to claim 12, wherein the notch antenna is provided at an end side of the dielectric layer which intersects with the polarization direction.

16. The antenna element according to claim 10, including a plurality of antenna elements arrayed in a one-dimensional or two-dimensional manner, wherein the plurality of antenna elements share the dielectric layer and the first ground conductor pattern.

17. An antenna module comprising:

the antenna element according to claim 10; and a power feeding circuit that feeds the radio frequency signal to the power feeding conductor pattern, wherein the first parasitic conductor pattern is provided on a first main surface of the dielectric layer, the first ground conductor pattern is provided on a second main surface of the dielectric layer, which opposes the first main surface, and the power feeding circuit is provided on the second main surface side of the dielectric layer.

18. A communication apparatus comprising:

the antenna element according to claim 10; and an RF signal processing circuit that feeds the radio frequency signal to the power feeding conductor pattern, wherein the RF signal processing circuit includes:

a phase shift circuit shifting a phase of the radio frequency signal;

an amplifying circuit amplifying the radio frequency signal; and a switch element switching connection between a signal path through which the high-frequency signal propagates and the antenna element.

* * * * *